US006290421B1

(12) United States Patent
Welch

(10) Patent No.: US 6,290,421 B1
(45) Date of Patent: Sep. 18, 2001

(54) BINDER WITH SPINE WINDOW AND REMOVABLE INSERT THEREIN

(75) Inventor: Stephen R. Welch, Downers Grove, IL (US)

(73) Assignee: ACCO Brand, Inc., Lincolnshire, IL (US)

( * ) Notice: Subject to any disclaimer, the term of this patent is extended or adjusted under 35 U.S.C. 154(b) by 0 days.

(21) Appl. No.: 09/506,394

(22) Filed: Feb. 18, 2000

Related U.S. Application Data

(63) Continuation of application No. 09/277,390, filed on Mar. 26, 1999, now Pat. No. 6,109,812.

(51) Int. Cl.[7] ..... B42F 3/00

(52) U.S. Cl. ..... 403/3; 281/29; 281/31; 402/70; 402/73

(58) Field of Search ..... 281/36, 29, 45, 281/31, 38; 402/70.79, 73, 3

(56) References Cited

U.S. PATENT DOCUMENTS

| | | | | |
|---|---|---|---|---|
| 4,244,603 | * | 1/1981 | De Monti | 402/3 |
| 4,315,642 | * | 2/1982 | Errichiello | 281/33 |
| 5,037,136 | * | 8/1991 | McIntire | 281/15.1 |
| 5,330,279 | * | 7/1994 | Rubie | 402/3 |
| 5,413,430 | * | 5/1995 | Schrem et al. | 402/60 |
| 5,445,468 | * | 8/1995 | Pacione | 402/75 |
| 5,499,846 | * | 3/1996 | Philip | 281/29 |
| 5,601,312 | * | 2/1997 | Funkhouser | 281/21.1 |
| 5,876,143 | * | 3/1999 | Ong | 402/3 |
| 5,915,873 | * | 6/1999 | Karlis | 402/79 |
| 6,045,161 | * | 4/2000 | Ashcraft et al. | 281/37 |

* cited by examiner

*Primary Examiner*—A. L. Wellington
*Assistant Examiner*—Monica S. Carter
(74) *Attorney, Agent, or Firm*—Pennie & Edmonds LLP

(57) ABSTRACT

An insert for a window formed in a binder spine. The insert can be separate or part of a binder sheet. The insert is readily removable from said spine to be relabeled to indicate the materials located in the binder. The insert can be pivotally mounted relative to the spine or can be provided with openings that resiliently connect the insert to the rivets that secure the spine to the ring holder.

22 Claims, 2 Drawing Sheets

BINDER WITH SPINE WINDOW AND REMOVABLE INSERT THEREIN

This is a continuation of application Ser. No. 09/277,390, filed Mar. 26, 1999, now U.S. Pat. No. 6,109,812.

BACKGROUND OF THE INVENTION

This invention relates to a binder which includes a spine having a window portion into which indicia is located to identify the contents of the binder.

It is very desirable to have a binder that can contain different materials and have the immediate availability to change the identity of the materials in the binder by placing a different label on an insert located in a window provided in the spine. Binders can be used for any number of different sets of materials and when it is desired to change the contents of the binder the existing binders in the marketplace are not capable of readily changing the identification of the materials located in the binder. While it is possible, of course, to add labels to the exterior of the binder spine over a period of time does not make for a very attractive binder. It has long been desired to be able to customize the binder spine wherein the indicia identifying the materials in the binder can be readily changed in a quick and efficient manner and still present a very professional appearance.

In an office setting it is particularly important that the binder be usable for different materials and yet be able to provide a ready identification that will present a neat and organized arrangement.

SUMMARY OF THE INVENTION

In accordance with the present invention there is provided a binder in which the spine includes a clear window portion. Located within the window portion between the interior of the spine and the ring holder that is secured thereto there is located a readily removable insert. This insert is provided on its exterior surface with a label or other indicia that identifies the materials contained in the binder. The insert can be pivotally mounted relative to a rivet or other fastener connecting the ring holder to the spine at one end and resiliently held in place at its other end. The removable end defines an opening that fits over a rivet holding the ring holder in place. Thus, when it is desired to change the labeling on the exterior of the insert the insert can be pivotally moved away from the spine to facilitate another label being placed thereon. In another embodiment the insert is removably attached in the interior of the spine to several of the fastening means connecting the ring holder to the spine. Essentially, the insert defines keyhole shaped openings that resiliently fit over the rivets connecting the ring holder to the spine adjacent its interior and thus can be readily removed from the spine and another list of the binder contents placed therein.

While the insert can be a separate piece it can also be a scored portion of a single sheet. One side of the sheet will have a longitudinally extending scored portion that defines an insert that can fit into the spine section of the binder. The outer end of the scored portion has key-shaped openings that can fit over rivets securing the ring section to the spine in the manner as described with respect to the fully removable insert described above. Thus, every time you wish to insert new materials into the binder you can readily place the scored section identifying the new materials into the visible spine areas This is done by inserting the outer scored portion into the spine and securing it in place by clicking the keyhole openings around the rivets holding the ring holder in place. The score line readily permits the scored section to be placed in position while permitting the balance of the sheet to be located in its normal position in the binder. In this situation the sheet as well as the spine insert can be provided with indicia to identify the materials in the binder. Thus, the insert will provide a brief description of the binder contents and when the binder is pulled from the shelf the balance of the sheet will describe the contents in more detail such as a table of contents. If desired, the sheet can be provided with a vertical or horizontal pocket, slot portions for business cards, CD ROM, diskette or various other multimedia and computer accessories. The pockets can have flaps that open and close, edge snaps, velcro or any of a variety of closures.

These and other objects, features and advantages of the present invention will become apparent from the following description of the several embodiments.

DETAILED DESCRIPTION OF THE PREFERRED EMBODIMENT

Figure 1:
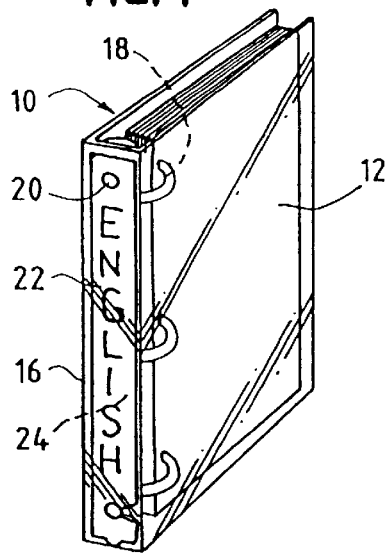
FIG. 1 is a perspective view of a binder showing the insert in position and identifying the materials in the binder.
Figure 2:
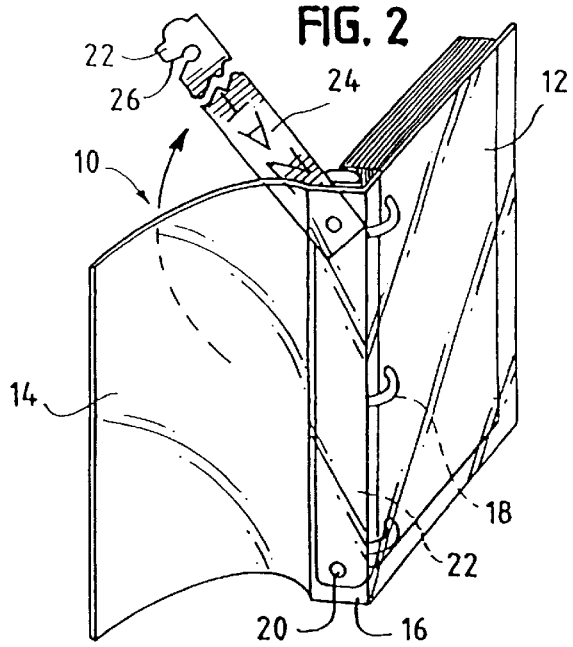
FIG. 2 shows the insert pivotally moved out from the window portion of the binder to facilitate the changing of the labeling on the insert.
Figure 3:
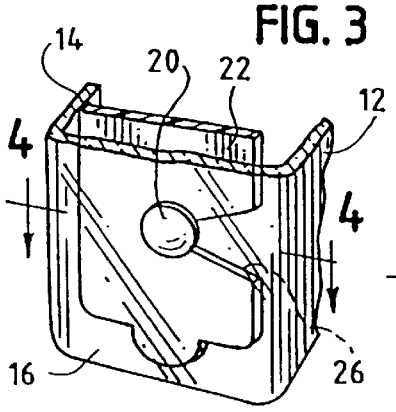
FIG. 3 is a partial perspective view showing how the lower portion of the insert is removably secured to the binder fastener means.
Figure 5:
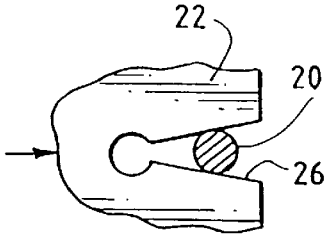
FIGS. 5 and 6 shows the various positions of the insert during its insertion into connecting relationship with the fastener connecting the ring holder to the spine.
Figure 6:
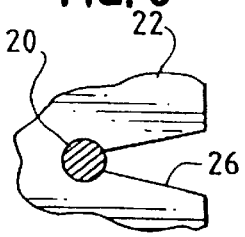
Figure 4:
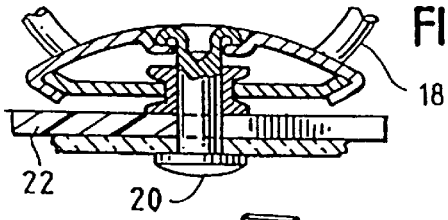
FIG. 4 is a plan view showing the fastener means connecting the ring holder and the insert in place relative to the spine.

Referring now to FIG. 1 a binder 10 is shown having a front cover 12 and a rear cover 14 and an intermediate spine 16. In this embodiment the binder is made of a clear plastic such as polypropylene but it can be made of other materials as long as the spine includes a transparent window. The ring holder 18 is secured to the spine through fasteners in which this case are rivets 20 one of which is shown in detail in FIG. 4. The insert 22 which is made of a relatively stiff but flexible material such as a cardboard contains a label 24 that identifies the materials located in the binder. Insert 22 is pivotally secured to rivet 20 at the upper end of the binder. The lower end of the insert 22 contains a key shaped a cutout portion 26 at its lower end which when moved into position in the spine clicks under the ring holder around the rivet 20 as shown in FIGS. 5 and 6 and resiliently fits thereover to retain the insert in position. It can readily be moved therefrom due to its resiliency.

It can be seen that the insert is shielded from exterior damage by its location on the interior of the spine adjacent the back of the ring holder.

Figure 7:
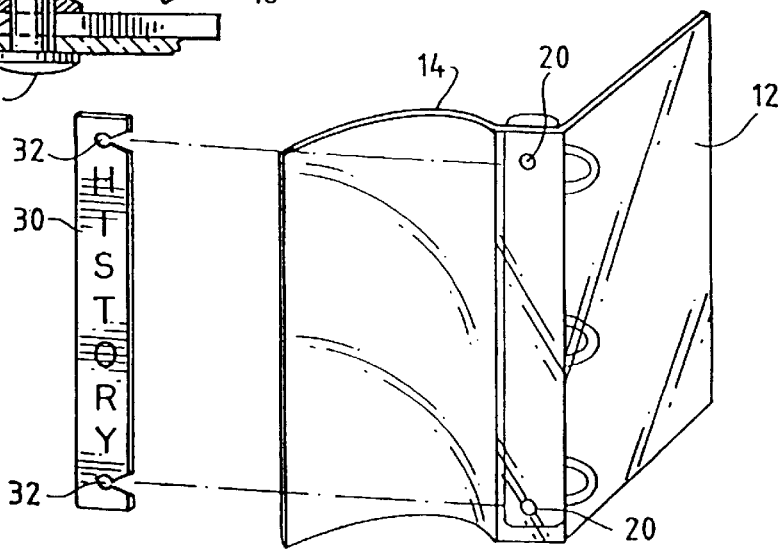
FIG. 7 is a view of a second embodiment in which the insert has keyhole shaped openings at its ends that receive the fastening means connecting the ring holder to the spine when the insert is moved into position.

A second embodiment is shown in FIG. 7 wherein the insert 30 has generally key shaped openings 32 and its upper and lower portions. When the insert is placed in position in the spine the openings 32 resiliently receive the fasteners connecting the ring holder to the spine.

Figure 8:
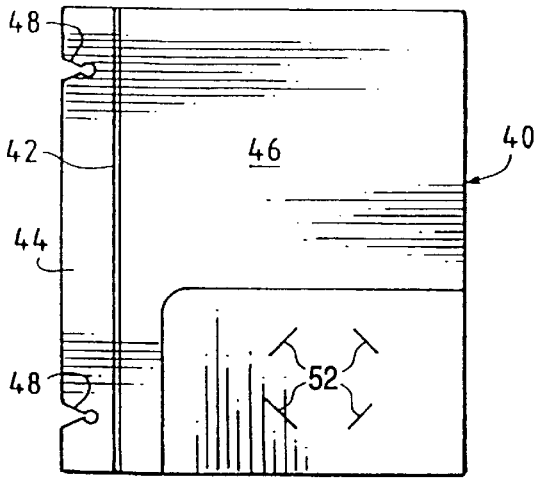
FIG. 8 illustrates another embodiment in which the insert is a scored section of a single sheet which sheet includes a horizontal pocket with business card slits.
Figure 9:
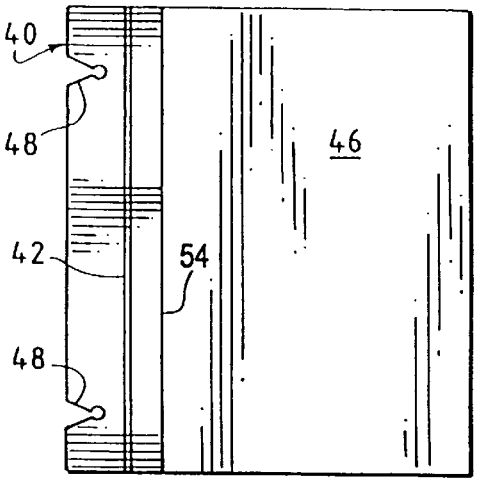
FIG. 9 is an embodiment similar to FIG. 8 in which the sheet includes a vertical pocket.
Figure 10:
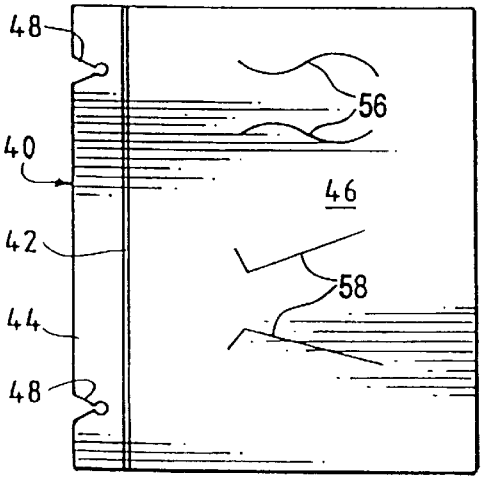
FIG. 10 is an embodiment similar to FIG. 8 in which the sheet includes slits for a CD ROM and a diskette.

A further embodiment is shown is FIGS. 8–10 in which there is disclosed a single sheet 40 made of relatively stiff stuff but flexible material. One side of the sheet 40 includes a score line 42 dividing the sheet into a spine insert section 44 with the balance 46 being the size of a normal sheet such as 8½×"11". The scored portion 44 is sized to fit into the spine area 16 and is similar to insert 30 shown in FIG. 7. The insert section 44 is provided with a label or otherwise suitably marked to indicate the contents of the binder. The balance of the sheet 46 may also include a table of contents or other information indicating what is in the binder. During assembly the insert 44 is bent or removed from the balance of the sheet 40 and inserted into the spine 16 with the openings 48 fitting over the rivets 20 to secure the insert in place. The balance of the sheet can remain affixed to the insert or if desired separated from the insert and provided with openings that will fit over the rings of the ring holder 18.

It is to be noted that the sheet 40 can be provided with a horizontal pocket 50 (FIG. 8), business card slits 52 (FIG. 8), a vertical pocket 54 (FIG. 9), slots 56 for a CD ROM (FIG. 10) slots 58 for a diskette (FIG. 10) or a variety of other multimedia or computer accessories.

Figure 11:
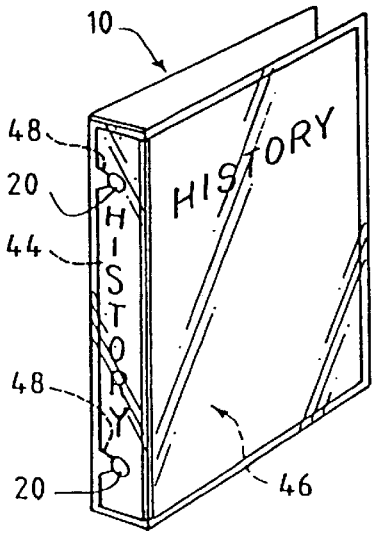
FIG. 11 is a perspective view illustrating the single sheet in position in the binder with the scored portion in position in the spine.

In FIG. 11 there is illustrated the sheet 40 in a binder with the insert 44 located in the spine 16.

While in the preferred embodiments the inserts are held in place by being disposed over the rivets it is within the scope of this invention to provide other retaining means within the spine area to hold the insert therein yet be readily removable therefrom.

It is intended to cover by the following claims all modification thereof that fall within the true spirit of the scope of the invention.

What is claimed is:

1. A binder, comprising:

at least one cover having an inner surface accessible from inside of the binder, an outer surface accessible from outside of the binder, and including a window portion to provide visibility through the cover;

a binding mechanism attached to the cover and adjacent the inner surface thereof and configured for holding materials; and an insert positionable in a first position between the inner surface and the binding mechanism and adjacent the window portion for identifying the contents of the binder through the window portion.

2. The binder of claim 1, further comprising a support disposed between the binding mechanism and the inner surface, wherein the insert is attachable to the support in the first position.

3. A binder, comprising:

at least one cover including a window portion;

a binding mechanism configured for holding materials;

a support disposed between the binding mechanism and the cover, the support supportingly connects the binding mechanism to the cover; and an insert positionable in a first position between the window portion and the binding mechanism for identifying the contents of the binder through the window portion, wherein the insert is attachable to the support in the first position.

4. The binder of claim 2, wherein the insert is removably attachable to the support for changing the insert.

5. The binder of claim 4 wherein the insert defines at least one mounting opening for removably engaging the support whereby the insert can be readily inserted and removed relative to the support.

6. The binder of claim 5, wherein the support comprises at least two support members and the mounting opening comprises at least two openings for engaging the support members.

7. The binder of claim 1, wherein the binding mechanism comprises a ring holder.

8. The binder of claim 1, wherein the insert is movable from the first position, in which a viewable portion of the insert is viewable through the window portion, to a second position in which the viewable portion is exposed from between the binding mechanism and the inner surface.

9. The binder of claim 8, wherein the insert is pivotably attached with respect to the window portion and pivotable between the first and second positions.

10. The binder of claim 1, wherein the at least one cover comprises first and second cover covers and a spine cover connected therebetween.

11. The binder of claim 10, wherein the window portion is disposed in the spine cover.

12. The binder of claim 1, wherein the window portion comprises a transparent portion.

13. The binder of claim 1, wherein the insert comprises an exposed portion that is exposed from between the binding mechanism and the window portion with the insert in the first position.

14. The binder of claim 13, wherein exposed portion of the insert includes a pocket.

15. A binder, comprising:

at least one cover having an interior side;

an interior member attached to the interior of the cover; and an insert pivotably attached with respect to the cover and interior member for pivoting between a first position with an insert portion thereof substantially concealed between the cover and the interior member and a second position with the insert portion exposed from between the cover and the interior member.

16. The binder of claim 15, wherein the interior member comprises a binding mechanism.

17. The binder of claim 15, wherein the cover includes a window portion for viewing through the cover.

18. The binder of claim 15, wherein the insert is pivotably attached with respect to the cover and interior member for pivoting generally in parallel with the cover between the first and second positions.

19. The binder of claim 15, wherein the insert portion is generally flat and rectangular and is pivotably attached with respect to the cover and interior member for pivoting substantially along a plane of the insert between the first and second positions.

20. The binder of claim 15, wherein the insert defines at least one mounting opening extending along an axis and the insert is pivotably attached with respect to the cover and interior member for pivoting around the axis of the opening between the first and second positions.

21. The binder of claim 3, wherein the insert is removably attachable to the support for changing the insert.

22. A binder, comprising:

at least one cover;

a binding mechanism configured for holding materials;

a support disposed between the binding mechanism and the cover, the support supportingly connects the binding mechanism to the cover; and an insert pivotably attached to the support.

* * * * *